US005239349A

United States Patent [19]

Hoover et al.

[11] Patent Number: 5,239,349

[45] Date of Patent: Aug. 24, 1993

[54] FUSER AND A FUSER ROLLER CARTRIDGE HAVING FUSING ROLLER SKIVE

[75] Inventors: Linn C. Hoover; Ralph E. Williams, both of Rochester, N.Y.

[73] Assignee: Eastman Kodak Company, Rochester, N.Y.

[21] Appl. No.: 830,034

[22] Filed: Jan. 31, 1992

[51] Int. Cl.[5] ..... G03G 15/20

[52] U.S. Cl. ..... 355/282; 219/216; 355/285

[58] Field of Search ..... 355/282, 285, 295; 219/216; 432/60

[56] References Cited

U.S. PATENT DOCUMENTS 4,127,764 11/1978 Minden ..... 219/216
4,782,359 11/1988 Tomoe ..... 219/216 X
4,839,694 6/1989 Kawashima et al. ..... 355/285 X
4,965,640 10/1990 Watarai et al. ..... 355/282 X
5,038,173 8/1991 Kusumoto ..... 355/282 X

*Primary Examiner*—A. T. Grimley
*Assistant Examiner*—William J. Royer
*Attorney, Agent, or Firm*—Leonard W. Treash, Jr.

[57] ABSTRACT

A fuser includes a pressure roller and a fusing roller and a skive for the fusing roller. The fusing roller is replaceable in a cartridge which has a housing which protects the fusing roller. The housing defines an access opening to the fusing roller and includes a skive for assisting in the separation of a receiving sheet from the fusing roller. The skive defines at least a portion of one edge of the access opening and is preferably molded integrally with the housing. A heat shield is positioned between the fusing roller and the housing to prevent the housing from becoming too hot to handle.

9 Claims, 11 Drawing Sheets

FUSER AND A FUSER ROLLER CARTRIDGE HAVING FUSING ROLLER SKIVE

TECHNICAL FIELD

This invention relates to image-forming apparatus having a toner image fuser. More particularly, it relates to such an apparatus in which the fusing roller requires periodic replacement.

BACKGROUND ART

One of the most commonly replaced and expensive components in conventional electrostatographic copiers and printers is a fusing roller. It is a costly item which wears out rapidly. It is generally replaced by a serviceman who must connect the roller to a suitable drive and locate temperature sensors, one or more skives and a fusing oil applicator at critical positions near or in contact with it.

U.S. Pat. No. 4,899,197 shows an electrophotographic apparatus in which a color toner image is formed on a receiving sheet. The receiving sheet is fed to conventional roller fuser having a heated fusing roller and an unheated pressure roller spring urged into contact with the fusing roller. The nip between the rollers is made accessible for servicing and for clearing jams by having the upper roller pivotable away from the lower roller with an upper portion of the image-forming apparatus.

Japanese Patent Application 63-107319 (1988), laid-open Nov. 7, 1989 (1-277271), shows a fuser in which a large portion of the entire fuser is replaceable in a single unit. The single unit includes both a pressure roller and the fusing roller and skives for each roller. It has the substantial disadvantage of replacing the more durable pressure roller assembly with the fusing roller. The mounting of separate skives in the replaceable unit appears complicated and costly.

SUMMARY OF THE INVENTION

It is an object of the invention to provide a fuser for fixing a toner image to a receiving sheet, which fuser has both a pressure roller and a fusing roller and at least a skive for assisting in the separation of a receiving sheet from the fusing roller, in which the fusing roller is easily replaceable, for example, replaceable by a less highly trained operator.

This and other objects are accomplished by a fuser in which the fusing roller is replaceable in a cartridge, which cartridge includes a housing having an access opening providing access to the fusing roller for engagement with the pressure roller. A skive for assisting in the separation of the receiving sheet from the fusing roller partly defines the access opening and, preferably, is molded integrally with the housing.

This object is also accomplished by a fusing roller cartridge for insertion in such a fuser, which cartridge has a housing, means defining an access opening in the housing and a fusing roller mounted for rotation within the cartridge. A skive for the fusing roller partly defines the access opening and, preferably, is integrally molded into the housing.

With this structure, replacement of the fusing roller is accomplished by removal of an old fusing cartridge and insertion of a new cartridge. The replacement of the fusing roller skive is automatically accomplished in this process with a skive that is extremely inexpensive, especially if it is molded into the cartridge housing as in the preferred embodiment.

According to a further preferred embodiment of the invention, the cartridge housing is protected in part from the heat of the fusing roller by a metal heat shield which is positioned between the fusing roller and the cartridge housing.

According to a further preferred embodiment, the access opening is covered by an openable cover. The housing can be made in two attachable parts. A top part is a one piece molded part in which the access opening, skive and a latch for the cover are all defined.

BEST MODE OF CARRYING OUT THE INVENTION

Figure 1:
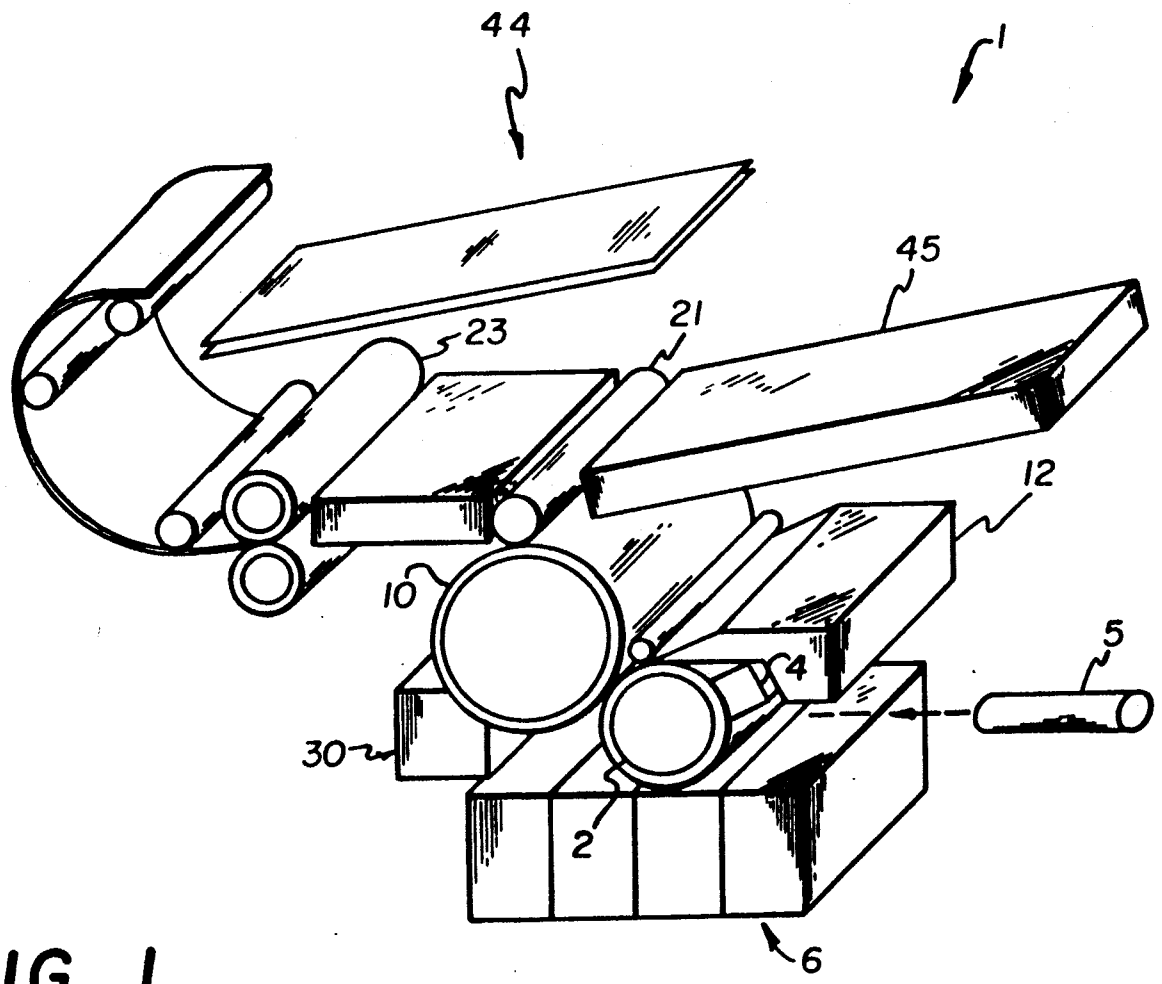
FIG. 1 is a perspective schematic of an image-forming apparatus showing essential stations without housing and other support structure.

According to FIG. 1, an image-forming apparatus, for example a color printer 1, includes a photoconductive drum 2 and a transfer drum 10. The transfer drum 10 is rotated by suitable means, not shown, and drives the photoconductive drum 2 through frictional engagement with it. This aspect of printer 1 is more thoroughly explained in U.S. Pat. No. 5,087,939 to D. R. McDougal, issued Feb. 11, 1992. The periphery of photoconductive drum 2 is moved past a charging station 4 and an exposure station, such as laser 5, to form a series of electrostatic images on the periphery utilizing conventional electrophotography. Each of the series of electrostatic images is toned by one of the toner stations in a development device 6. Development device 6 includes four stations, each containing a different color toner. It is indexed through operative relationship with drum 2 to apply different color toners to each of the images in the series of electrostatic images. The toner images so formed are transferred, in registration, to the periphery of transfer drum 10 under the influence of an electric field applied between the two drums to create a multicolor image on drum 10. Drum 2 is continuously cleaned by a cleaning device 12 and drum 10 is periodically cleaned by a cleaning device 30.

Receiving sheets are fed from a receiving sheet supply 45 into a nip formed between a transfer roller 21 and transfer drum 10. An electrostatic field applied between transfer drum 10 and roller 21 transfers the multicolor image to the receiving sheet. The receiving sheet is transported, for example, by drum 10 and roller 21, to a fuser 23 where the multicolor image is fixed to it and then transported to an output hopper 44.

For convenience of replacement, the photoconductive drum 2, charger 4 and cleaning station 12 can be included in a cartridge easily replaceable by the operator. Typically, except for these elements, a fusing roller in fuser 23 is the substantial "permanent" part most often in need of replacement. Replacement is traditionally done by a trained serviceman who must assure criticality in placement of temperature sensors, wicking devices, drives and a heating lamp or other element. As shown in FIGS. 2–13, this problem is solved by supplying and replacing the fusing roller in a cartridge which easily couples to the receiving apparatus.

Figure 2:
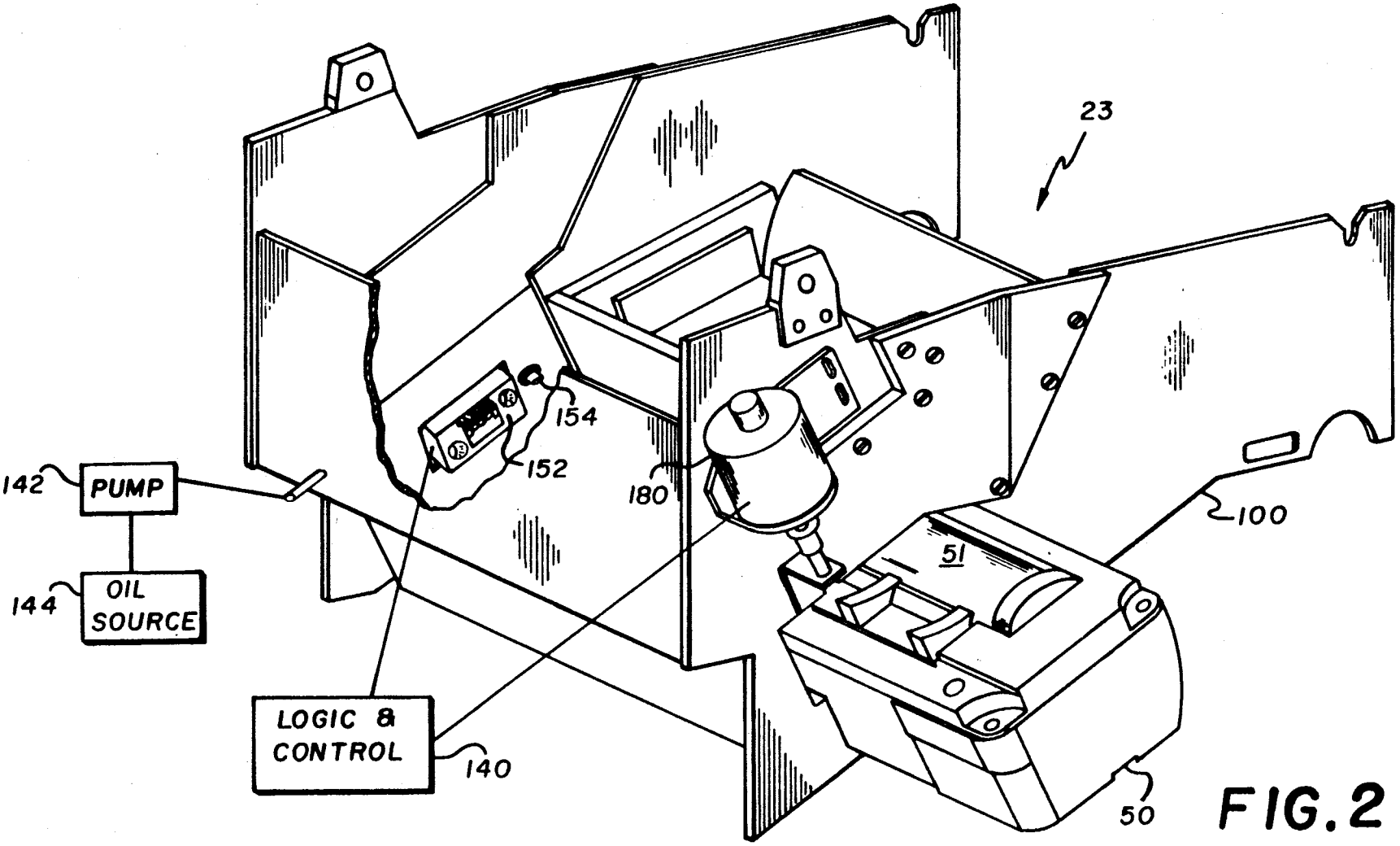
FIG. 2 is a perspective view of a fusing portion of an image-forming apparatus.

According to FIG. 2, a fusing roller cartridge 50 is insertable in, and becomes a part of, fuser 23 by movement in an endwise fashion by an operator. This process will be explained in more detail below.

Figure 3:
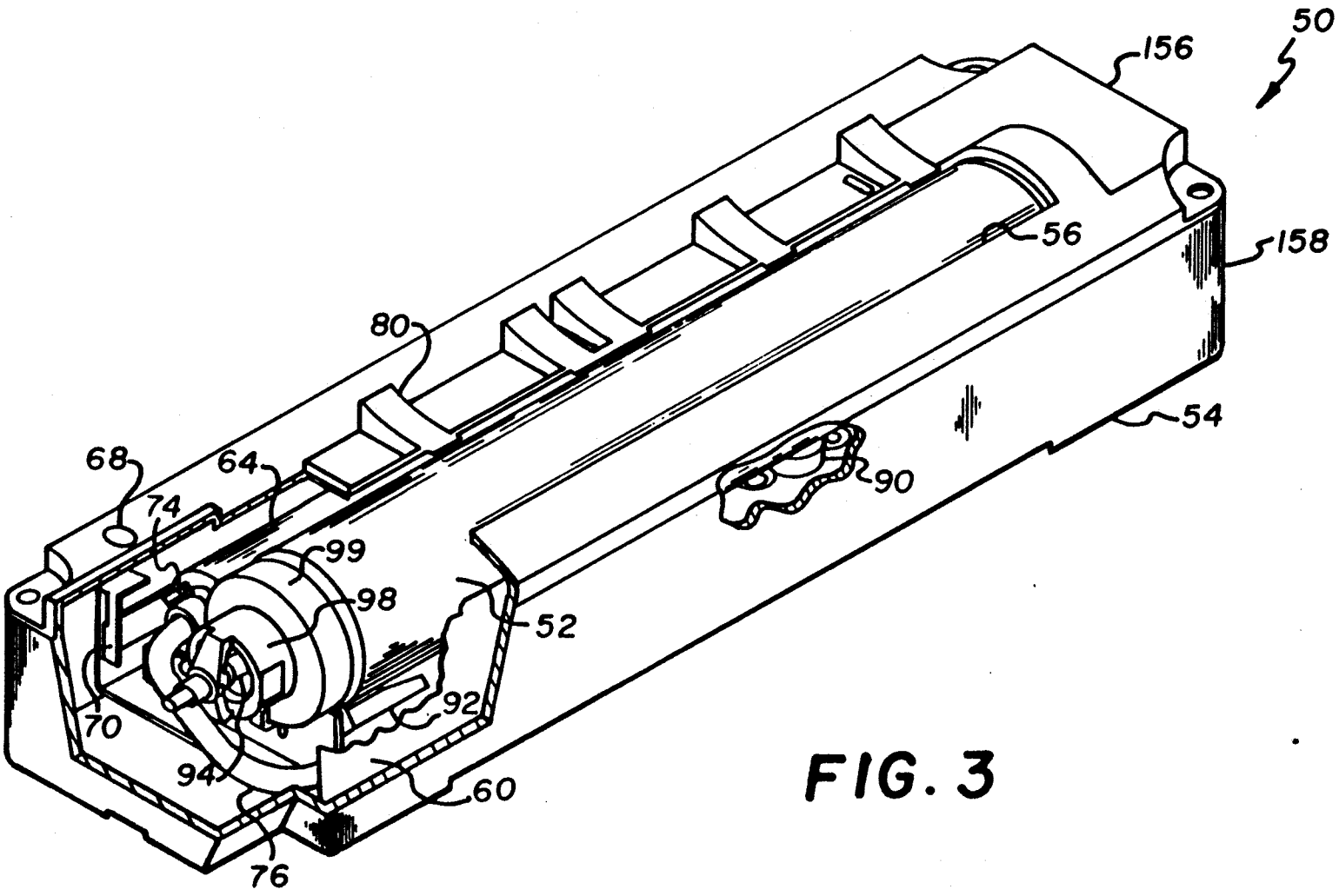
FIGS. 3, 4 and 13 are front, back and side perspective views of a fusing roller cartridge, respectively.
Figure 4:
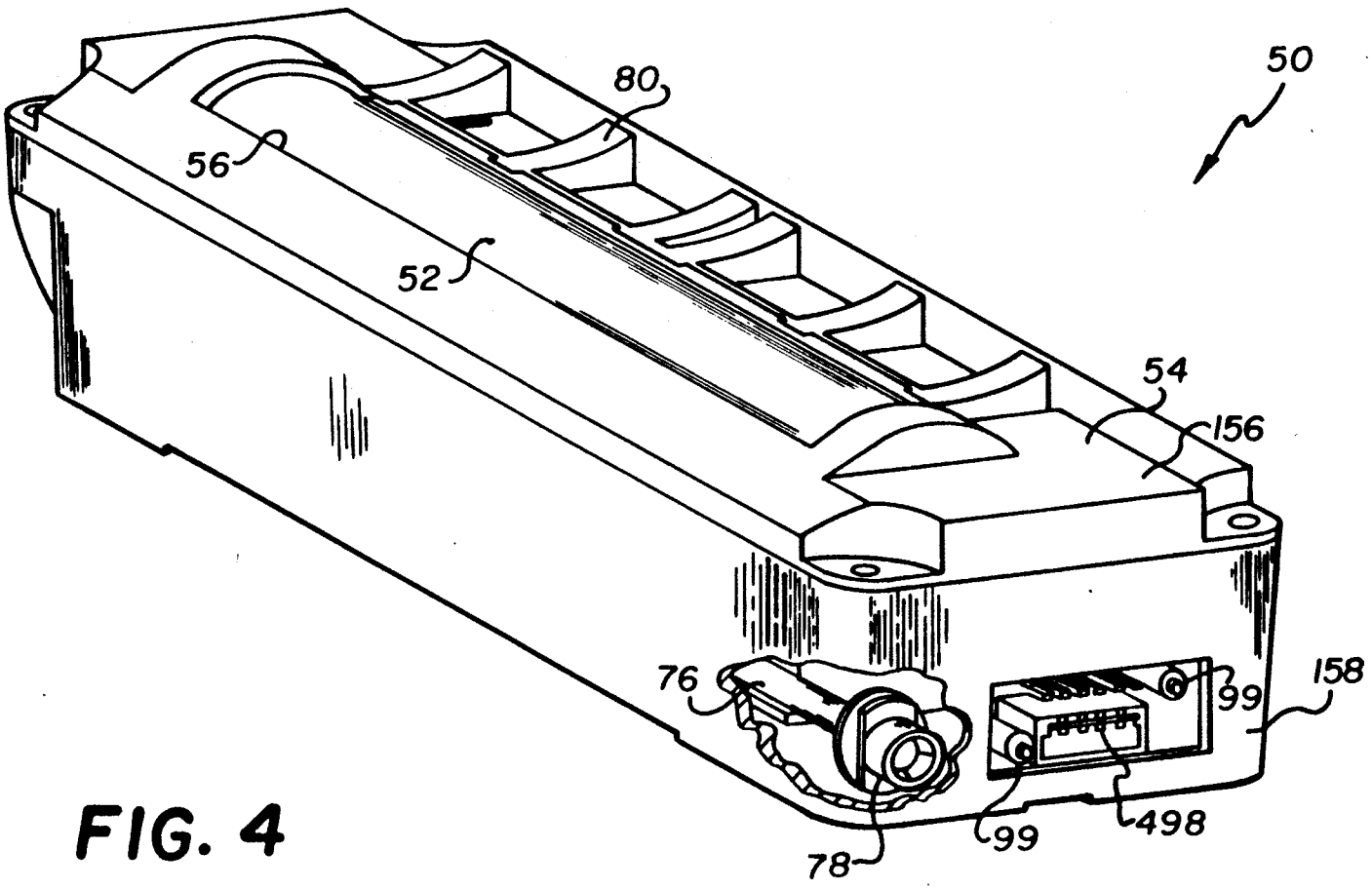
Figure 5:
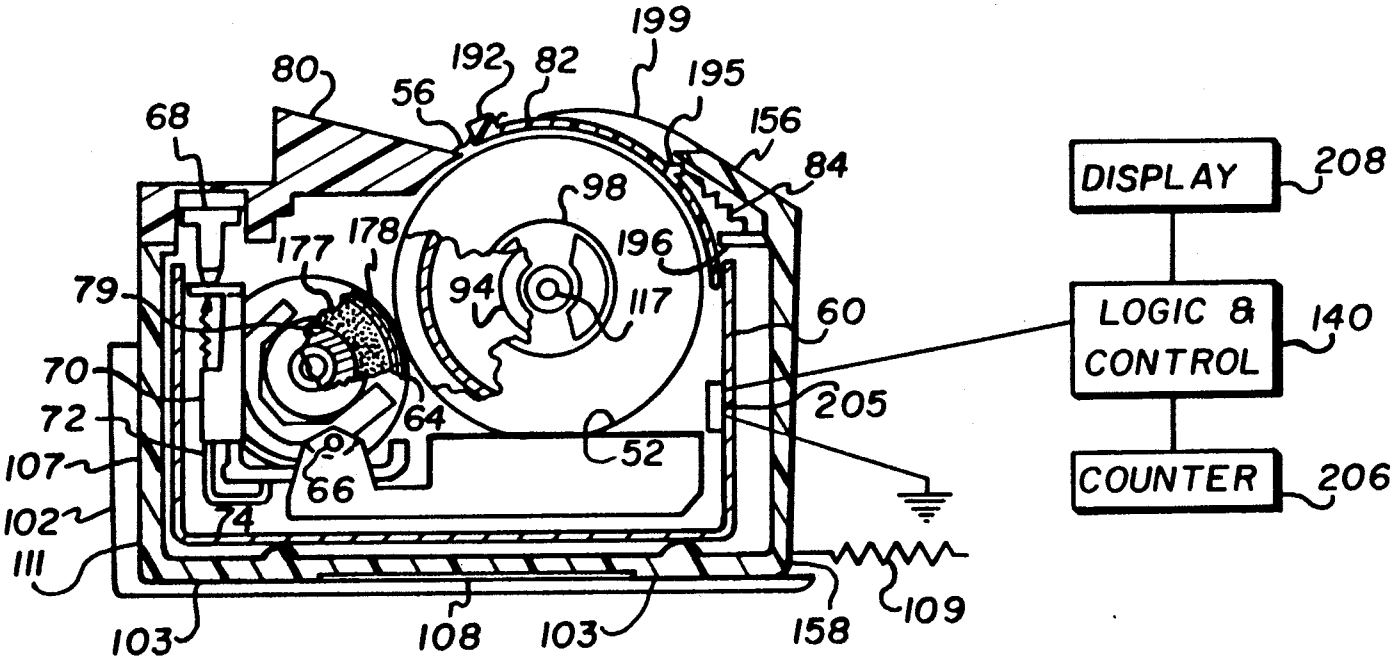
FIG. 5 is a section of the fusing roller cartridge shown in FIGS. 3 and 4.

According to FIGS. 3, 4 and 5, the fusing roller cartridge 50 includes a fusing roller 52 supported and entirely journaled for rotation within the cartridge 50 about an axis of rotation 117. Roller 52 is rotated with respect to bearing blocks 99 which are supported by suitable structure in the bottom of the cartridge. A fusing lamp 94 is supported by a plastic lamp housing 98 which housing rotates with fusing roller 52 and with respect to lamp 94 which is also fixed and not rotatable with respect to the cartridge. This entire unit, fusing roller 52, lamp 94, housing 98 and bearing blocks 99 can be easily made as a unit and assembled in one step in cartridge 50.

A plastic housing 54 substantially surrounds the fusing roller except for an access opening 56. The housing is made in two parts, an upper part 156 and a lower part 158 which are secured together by screws in holes shown in the corners. The access opening 56 is covered by a cover 82 shown in its closed position in FIG. 5 and movable to a noncovering position by means described in more detail below. A heat shield 60 secured in lower part 158 surrounds the bottom and sides of fusing roller 52 and is made of metal or another heat-blocking material to reduce the tendency of plastic housing 50 to heat to a temperature making it untouchable. As best seen in FIG. 5, it is separated from housing 50 by a small heat insulating airspace.

Figure 13:
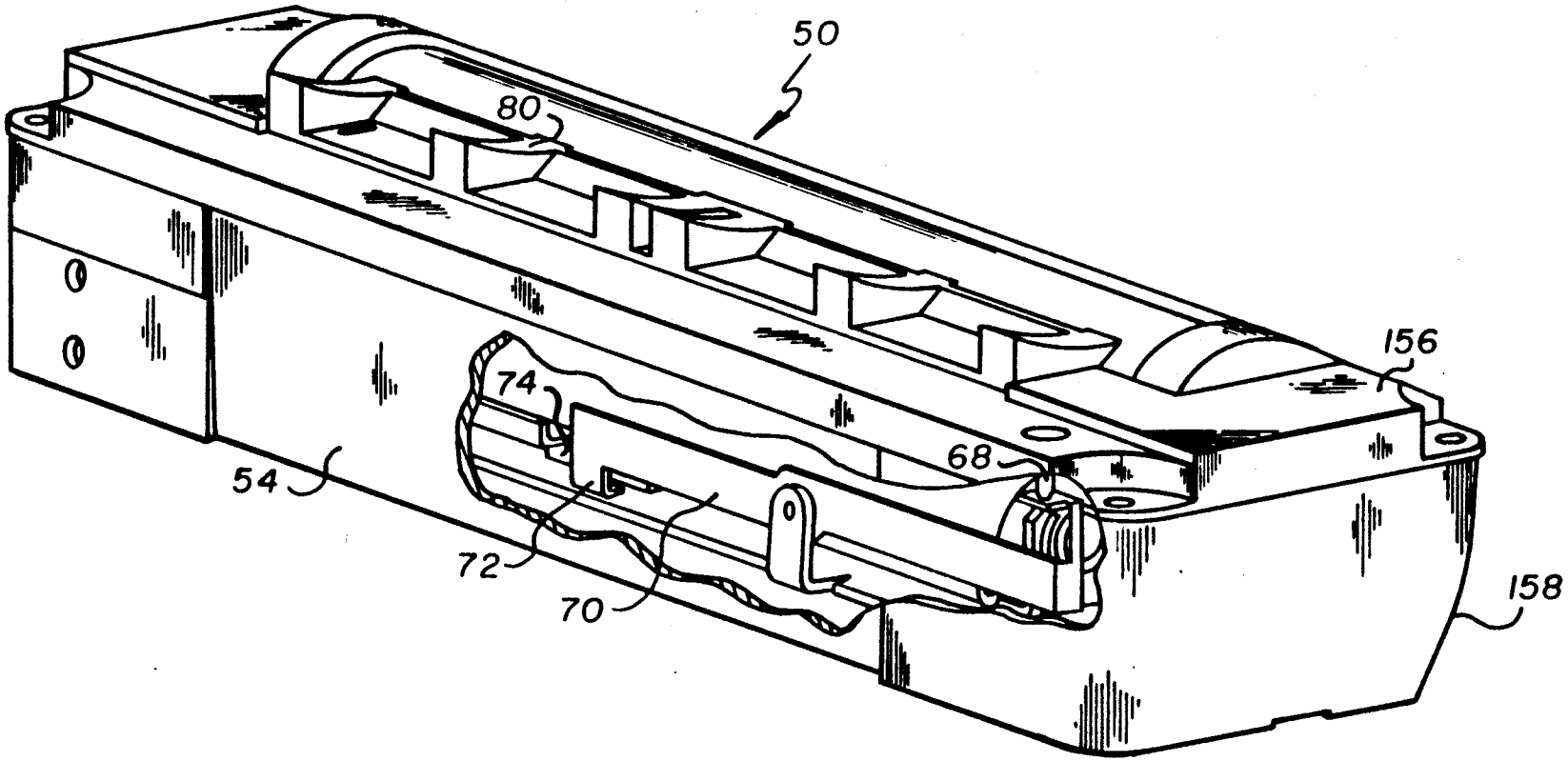

A rotatable wick 64 is best seen in FIGS. 3 and 5. Wick 64 is similar to rotatable wicks presently being used in the industry to apply offset-preventing liquid (fusing oil) to fusing roller 52, except it is totally contained in the cartridge. It is journaled for rotation by frictional contact with fusing roller 52 and is articulatable about a wick pivot point 66 by depression of a wick plunger 68. Plunger 68 is connected to a wick actuator arm 70 which is connected by an actuator arm pin 72 to a suitable yoke 74 (FIG. 13). As shown in FIGS. 3 and 4, oil is supplied to wick 64 through a liquid transport tube 76 which runs from an axial supply position at one end of a distribution tube 79 internal to wick 64, to a cartridge oil connector valve 78 which protrudes from the opposite end of cartridge 50. The tube 76 thus transports oil from valve 78 to distribution tube 79. The wick 64 includes a porous ceramic core 177 wrapped with a conventional wicking material 178. One wrap is conventional, although more wraps could be used.

Oil application to fusing roller 52 is controlled by actuation and deactuation of a wick actuation solenoid 180 (shown in FIG. 2) in the receiving apparatus. Solenoid 180 depresses wick plunger 68 to rotate wick 64 into rolling engagement with fusing roller 52, i.e., wick 64 is moved clockwise around wick pivot point 66, into a first position shown in FIG. 5. The wick is spring urged to a second position separated from roller 52 when solenoid 180 is not actuated and plunger 68 is not depressed. As shown in FIG. 13, movement of the right end of actuator arm 70 (FIG. 3) downward causes the left end to pivot upward. Pin 72 is coupled between the left end of arm 70 and cradle 74 to move cradle 74 clockwise (FIG. 5) around pivot 66. A typical wicking algorithm would call for deactivation of the solenoid 180 after a certain number of copies to prevent over-oiling of the fusing roller 52. The algorithm may vary according to the type of receiving sheet and the type of image. Such algorithms are well known in the art and are implemented by a logic and control 140 (FIG. 2).

It is known that the greater force applied between the wick and the fusing roller, the greater the oiling. Thus, an alternative construction would move the wick between positions in which more and less oil is applied. In the embodiment shown, the wick is either applying oil or not.

With wick 64 and its articulation mount, including yoke 74, actuator arm pin 72 and actuator arm 70, all contained in the cartridge, there is no connection or alignment that need be separately made by the operator with respect to the fusing roller oiling mechanism while replacing the fusing roller. As will be described more fully below, connection of valve 78 and alignment of plunger 68 with solenoid 180 are automatic with full insertion of the cartridge.

Attached to, or preferably, integral with (see FIG. 5) the top of housing 54 is a paper skive 80 which is positioned and shaped to prevent reattachment of a receiving sheet to the fusing roller as it exits the nip between the fusing roller and a pressure roller and to guide the receiving sheet further on its path. Logic and control 140 controls laser 5 and the sheet transport portion of printer 1 to not print on the first ¼ inch of the receiving sheet. This front portion, thus, does not have a tendency to stick to the fusing roller and is engaged by the point of the skive. Preferably, skive 80 is molded into the housing 54 and does not have to be separately assembled. It has a tapered edge (or edges) positioned just out of contact with fusing roller 52. The tapered edge defines part of access opening 56. The skiving surface can be straight, as shown in FIG. 5, or curved (as shown in FIG. 3) in either direction, depending on the curl tendency of the paper as it exits the fusing nip. Upper part 156 of housing 54, thus, is a one piece molded unit which defines both the skive and the access opening.

A cover 82 is urged by a spring 84 toward a closed condition covering access opening 56, as shown in FIG. 5. Cover 82 protects fusing roller 52 from damage from handling when the fusing roller is outside of the image-forming apparatus. It also prevents the operator from touching a hot fusing roller when removing the cartridge. Cover 82 moves in arcuate grooves 194 in end-pieces 199 in the cartridge.

FIG. 5 illustrates a first embodiment of cover 82. According to FIG. 5, cover 82 is movable by the operator's thumb on a lug or finger grip 192 against the urging of spring 84 to an uncovering position in which a flexible latch member 195 on cover 82 latches on a latch 196 integral with housing 54. (Latch 196 can also be molded into the top part 156 of housing 54.) The cartridge is inserted, used and removed with the cover in the uncovered, latched condition. After removal, the cover can be closed by the operator, overcoming latch 196.

Figure 8:
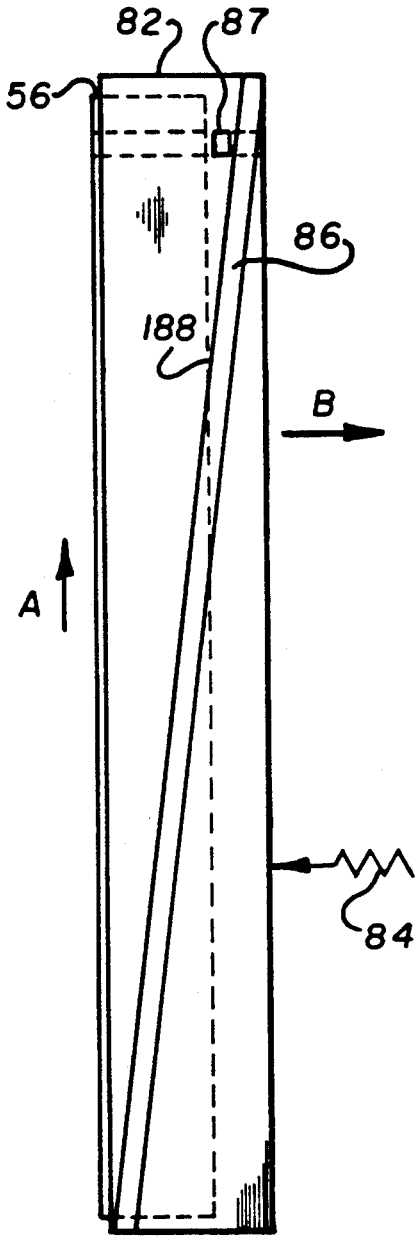
FIGS. 8, 9 and 10 are top schematic views illustrating alternative embodiments of a cover for the cartridge illustrated in FIGS. 3–5.
Figure 9:
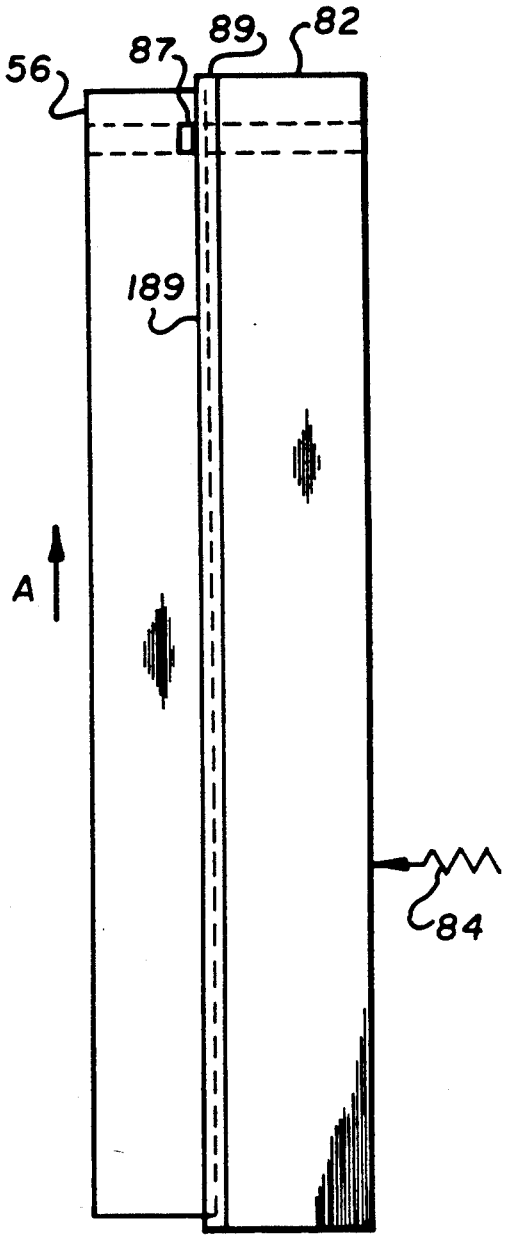

FIGS. 8 and 9 illustrate second and third embodiments of cover 82. According to FIG. 8, cover 82 has a cam surface 188 formed as the left vertical surface of an elongated rib 86 which is slanted with respect to the axis of rotation 117 of fusing roller 52. Rib 86 is molded into cover 82. When the cartridge is inserted by motion parallel to axis 117 (in the direction of arrow A in FIG. 8), cam surface 188 rides to the right of a lug 87 (shown also in FIG. 6) on the receiving structure. Lug 87 forces cover 82 in the direction of arrow B, uncovering access opening 56 against spring 84.

As shown in the FIG. 9 embodiment, the cover also can be opened by the operator before insertion, and a latch surface 189 on a rib 89 rides on lug 87, keeping the cover latched in an uncovering position. In either of the FIG. 8 or FIG. 9 embodiments, the cover would be closed by the spring 84 when the cartridge is removed. Also in either embodiment, the lug 87 must project deep enough into the apparatus to maintain contact with its respective cam surface 188 or 189 on the cover 82, when the cartridge is fully inserted.

With either of the FIGS. 5 or 9 approaches, the cover does not close until the cartridge is fully removed. In FIG. 8, it closes as it is removed. In all three embodiments, especially those shown in FIGS. 5 and 9, there is a chance that the operator will touch the uncovered or partly covered fusing roller while removing the cartridge. If the cartridge is being removed immediately after use, the fusing roller will be very hot for operator contact.

Figure 10:
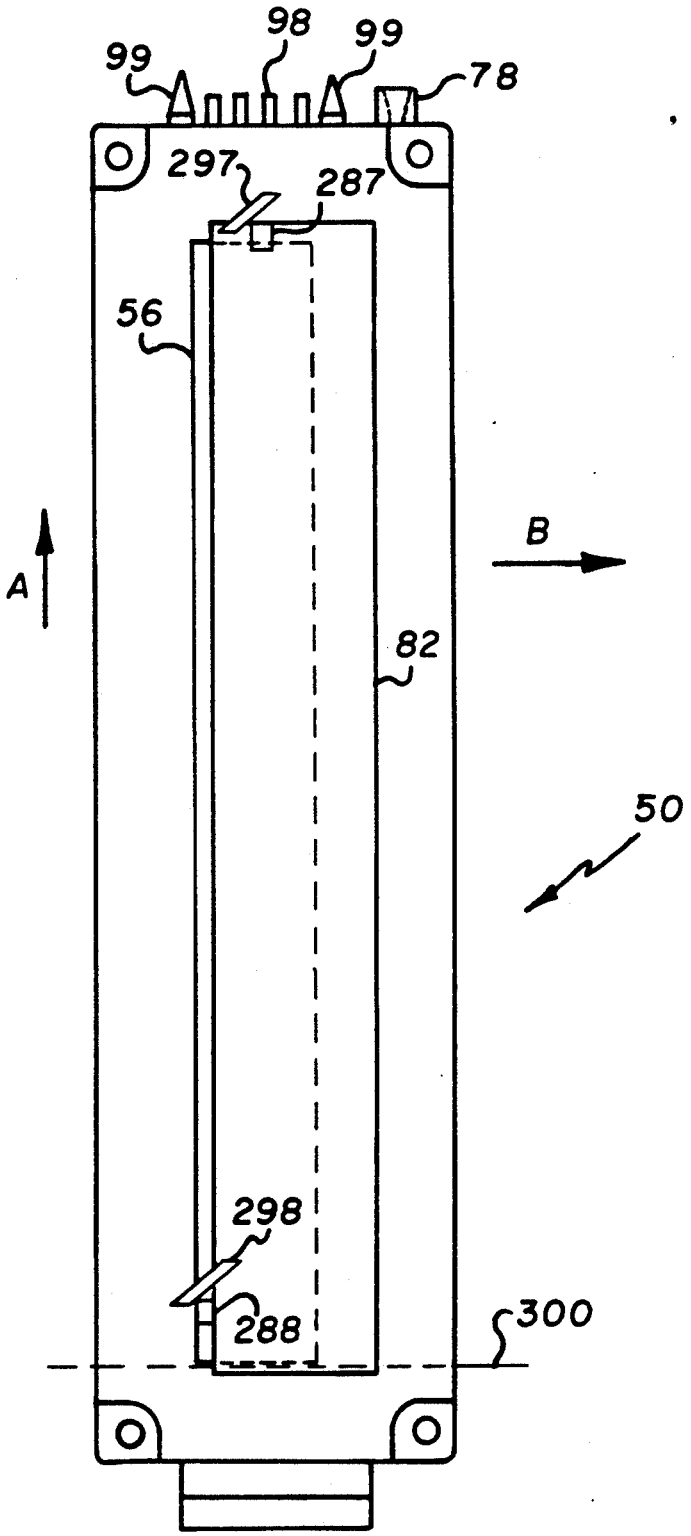

This problem is solved with a preferred form of the cover and receiving mechanism, shown in FIG. 10. According to FIG. 10, cover 82 includes front and back upwardly protruding lugs 287 and 288, respectively. The receiving apparatus includes downwardly projecting ribs 297 and 298. The lugs are offset laterally so that, as the cartridge is inserted, lug 287 passes to the right of rib 298. Lug 288 can also protrude to the left of the cover 82, as shown in FIG. 10.

As the cartridge 50 is inserted into the receiving apparatus of fuser 23 by movement in direction A, the lug 287 passes to the right of rib 298. The cover does not open until lug 287 engages rib 297 and lug 288 simultaneously engages rib 298. The two engagements work together to open cover 82 as or after the opening 56 passes under the outside surface defining the receiving opening, illustrated by line 300 in FIG. 10. The outside surface 300 defining the receiving opening, thus, prevents accidental touching of the fusing roller when the access opening is uncovered. Alternately, the lugs and ribs could be laterally aligned and vertically offset, instead of laterally offset, i.e., lug 287 and rib 297 could be below lug 288 and rib 298, respectively, instead of laterally offset, as shown, or both.

Note that the same effect from a cover opening timing aspect could be obtained by a single lug and rib in the middle of the apparatus, although care must be taken to avoid the paper path in locating the rib. However, using more than one set of lugs and ribs spreads the opening force across the cover and prevents misalignment due to localized sticking of the cover.

The cover also can be opened after insertion by suitable motorized or manual structure. For example, a pressure roller (to be described below) could drive a gear which engages the cover to open it, or the movement of the pressure roller into engagement with the fusing roller could actuate a mechanism to open the cover.

Cartridge 50 also includes the necessary electrical components associated with the fusing roller 52. A high temperature sensor 90 interrupts an electrical signal in response to sensing a temperature of the fusing roller above a critical high temperature, which cuts off the voltage to the fusing lamp. A thermistor temperature sensor 92 senses the temperature associated with an edge of the outside surface of the fusing roller 52. It is used according to a temperature control algorithm to control the energy applied to a fusing lamp 94 positioned along the axis of fusing roller 52. Like the oil-applying mechanism, the temperature sensors and the heating lamp are included in the cartridge and, therefore, the fusing roller does not have to be mated with them when installed by an operator of serviceperson. Location of thermistor temperature sensor 92 with respect to the fusing roller is critical to operation of the fuser. Elimination of its positioning in the fuser roller replacement process is important to operator replacement.

FIG. 5 also shows a thermally sensitive fuse 205 located between the fusing roller 52 and the heat shield 60. It is of a type presently used in some industries for high temperature detection. If its temperature passes a predetermined level, it irreversibly blows, breaking whatever circuit the fuse is in. Fuse 205 is positioned and designed to blow when heat from the fusing roller raises the fuse temperature to a level above its highest ambient, storage and shipping temperature but below fuser operation temperature. Thus, it blows during the first operation of the fuser after insertion of the new cartridge.

When the cartridge is inserted in the printer 1, the fuse is connected in a current-carrying circuit to logic and control 140 through an electrical connector 498, discussed below. Logic and control 140 detects the completed circuit shown schematically in FIG. 5 and resets the apparatus for a new fusing roller cartridge. For example, logic and control 140 resets an electronic counter 206 to zero. Counter 206 can count either the number of images or receiving sheets or both made since the cartridge was inserted. A display 208 indicating either or both of those values is accessible to the operator. Display 208, in response to either to either value, can also signal the operator that the fusing roller life is extending beyond normal. For example, in response to a diagnostic input in which the operator inputs an indication of poor image quality, logic and control 140 responds with the information that the fusing roller life may be the problem. This can be indicated alone or as part of a probability list with other possible causes. Appropriate programming within the skill of the art would provide the probability list and its arrangement according to fuser cartridge usage and usages of other components in the printer 1.

If the cartridge is removed, an insertion of a new cartridge would reset the counter 206. A reinsertion of an old cartridge would not reset the counter because fuse 205 is detected as blown (or not detected as not blown) by the logic and control 140. So removal of the cartridge for any service other than replacement would not reset the counter. Fuse 205 can be any thermally sensitive device that irreversibly changes an electrical circuit from a first to a second condition in response to the device reaching a predetermined temperature.

Referring to FIGS. 2 and 4, both the cartridge oil connector valve 78 and the electrical connector 498 are positioned at the end of the cartridge that is the leading end during insertion. With the assistance of appropriate guide pins 99, a firm insertion by the operator links both the valve 78 and the electrical connector 498 to complementary connections on the receiving apparatus, as part of the inserting process. More specifically, a receiving electrical connector 152 receives both pins 99 and cartridge electrical connector 498. A receiving apparatus liquid connecting means, for example, a check valve 154 mates with cartridge valve 78, which mating opens check valve 154 to allow oil to flow from a suitable source or supply, for example, when pumped from a reservoir 144 by a pump 142. Both the reservoir and pump are located in the receiving apparatus and are conventional. Receiving connector 152 and check valve 154 are preferably separately mounted to be movable a small amount (float) by the pointed portions of pins 99 and tapered mouth of valve 78 to allow some vertical and horizontal tolerance in the insertion process.

Figure 6:
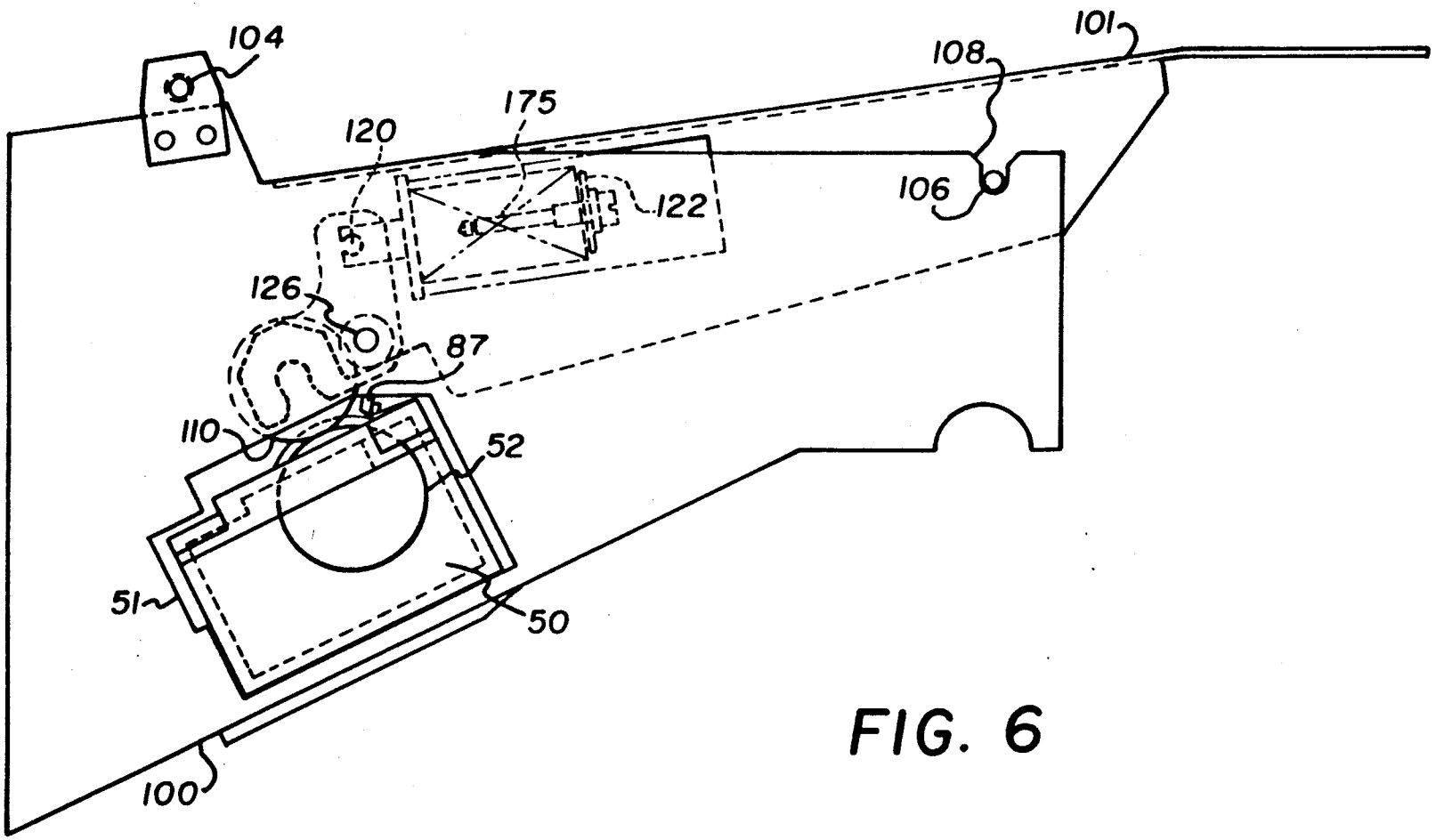
FIGS. 6 and 7 are front and perspective views illustrating the relationship of a pressure roller and its mounting structure with the fusing roller cartridge shown in FIGS. 3–5.

FIGS. 5 and 6 illustrate the position of the cartridge 50 when received in and part of the fuser 23. The cartridge 50 (also as shown in FIG. 2) is inserted in a slot or opening 51 until the electrical and oil connectors are mated. According to the FIGS. 8 and 10 embodiments, the cover 82 opens in this process as described above.

Slot 51 is located in a lower frame 100 of the printer 1. The cartridge 50, as electrical and oil connections are made, stops and is supported by receiving means 102 (FIG. 5). Receiving means 102 defines a horizontal guide surface 108 and a vertical guide surface 107 on which the cartridge rides during insert and upon which it eventually seats. Four seating pads 103 at the four corners of the bottom surface of the cartridge are supported by surface 108. They are formed within sufficiently tight tolerances to assure accurate height for fusing roller 52 and of connector 498, valve 78 and plunger 68. Similar pads (not shown) can be placed on the left side wall 111 of the cartridge which is guided by surface 107 to assure the lateral position of the fusing roller and connector 498, valve 78 and plunger 68.

A leaf spring 109 can be used to urge the cartridge to the left to maintain contact of the vertical wall 111 of the cartridge and surface 107. However, this spring can be eliminated if the receiving means 102 and/or opening 51 is tilted counter-clockwise as shown in FIGS. 2 and 6, by, for example, 25°. With this orientation, gravity maintains both the pads 103 against surface 108 and the sidewall 111 against surface 107, eliminating the need for spring 109. The amount of tilt necessary depends on the weight of the cartridge and the coefficients of friction of the pads 103 and surface 108.

A pressure roller 110 is carried in an upper frame or structure 101 (FIG. 6). Upper structure 101 is fixed to lower frame 100 and is movable counter-clockwise about a pivot 104 to swing upper structure 101 between a closed position and an open position (shown in FIG. 6). In the closed position a pair of pins 106 in the upper structure fit in slots 108 in the lower structure (only one pin and slot being shown in FIG. 6). This position is firmly maintained during operation of the fuser by an overridable detent, not shown. Pressure roller 110 is carried in the upper structure and moves into operative relationship with the fusing roller 52 when the upper structure is closed.

Figure 7:
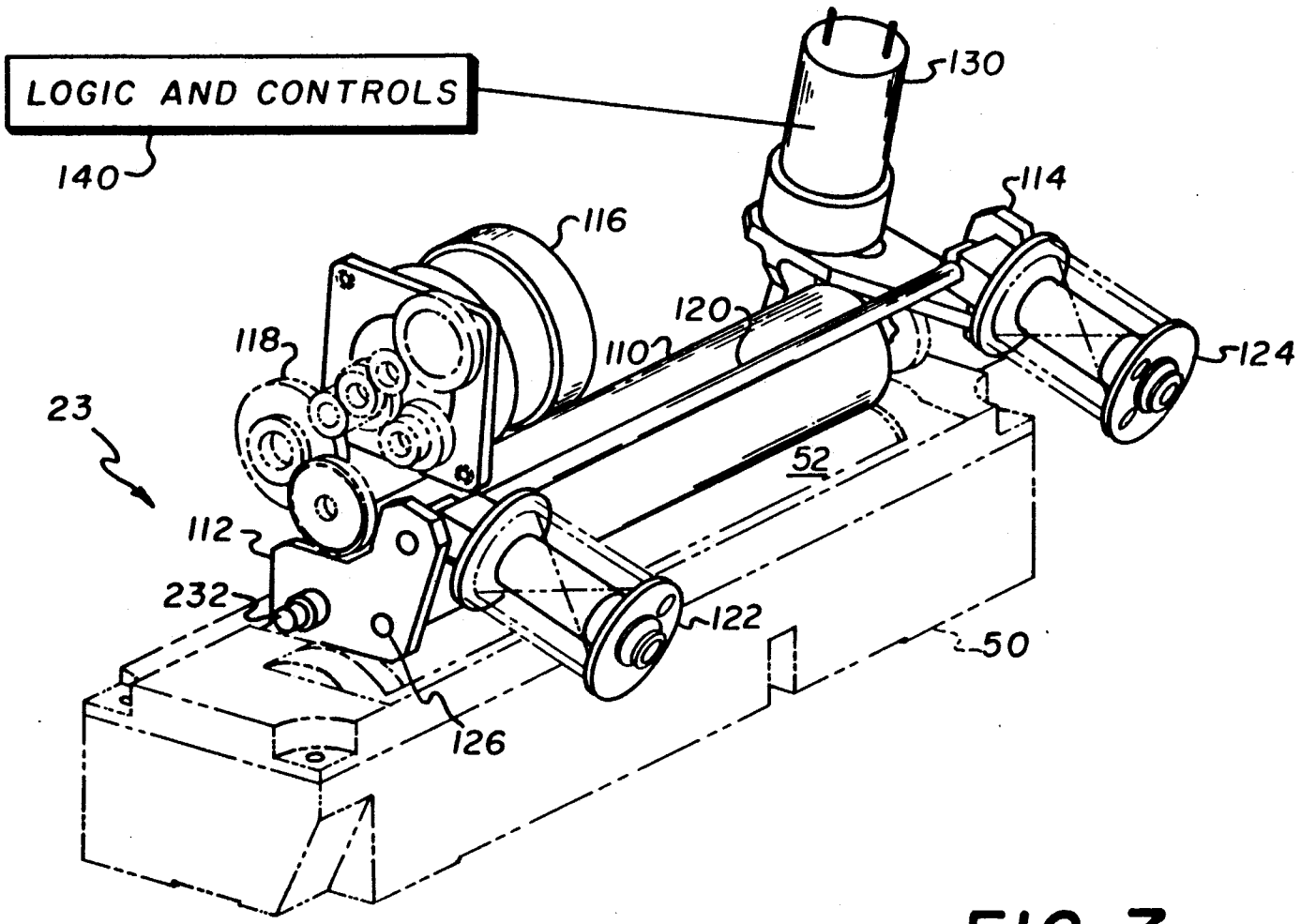

According to FIGS. 6 and 7, pressure roller 110 is supported by a pair of support arms 112 and 114 which are connected by a spring arm 120. Pressure roller 110 is rotatable during fusing by a stepper motor 116 through a set of gears 118. The motor 116 is fixed in upper section 101. A pair of springs 122 and 124, also fixed in upper section 101, are connected to spring arm 120 and urge arms 112 and 114 in a counter-clockwise direction around a pivot 126 which pivot is stationary with respect to upper section 101.

When springs 122 and 124 are depressed, they rotate arms 112 and 114 with a substantially constant force through their operative range. This force applies a desired pressure between pressure roller 110 and fusing roller 52 when upper section 101 is in its lowered and operating position. In operation, the fusing roller 52 is rotated by frictional engagement between it and the pressure roller 110. Therefore, stepper motor 116 drives both the fusing roller and pressure roller. This advantageous construction allows the cartridge 50 not to have separate connections for driving the fusing roller 52. It allows the cartridge assembly to be more simple as well with the fusing roller lamp and bearings made as a single unit that are fastened in the cartridge without the need for a drive connection within the cartridge.

Figure 11:
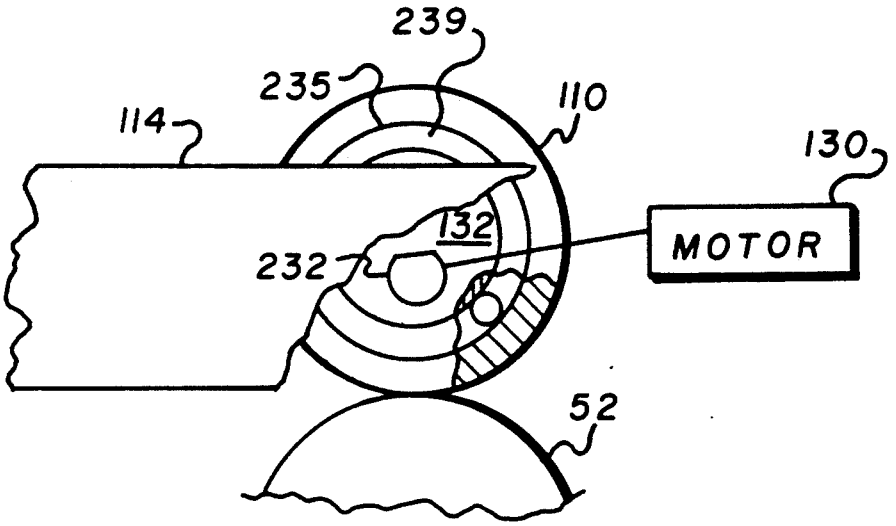
FIGS. 11 and 12 are rear views, partially schematic, with many parts eliminated illustrating operation of a pressure roller mounting structure.
Figure 12:
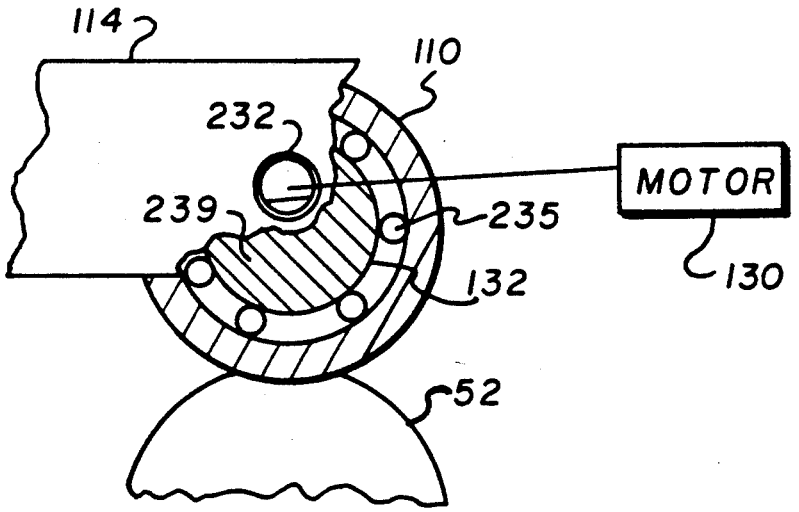

During standby or shutdown, to prevent heatset, it is desirable to separate the rollers or lower the force urging them together. This is accomplished by raising the axis of rotation of pressure roller 110 with respect to arms 112 and 114. Referring to FIG. 11, pressure roller 110 is rotatably supported in arms 112 and 114 by a shaft 232. Shaft 232 is eccentrically fixed in two cylindrical eccentrics 132 located at opposite ends of roller 110. (Alternatively, a single eccentric running the length of roller 110 could be used.) The outside cylindrical surfaces of eccentrics 132 form the inner bearing support surfaces for bearings 235 on which roller 110 rotates about a primary axis 239 when the fuser is in operation. Eccentrics 132 are, thus, bearing supports for bearings 235.

In FIG. 11, the roller 110 is shown with shaft 232 in its lower position with respect to roller 110 which forces axis 239 to an upper position. In this position pins 175 limit movement of springs 122 and 124, preventing them from expanding beyond a predetermined position and, as a result, pressure roller 110 is separated slightly from fusing roller 52. In operation, motor 130 rotates shaft 232 around a secondary axis of rotation in the center of shaft 232 through conventional gearing, not shown, to rotate eccentric 132 to the position shown in FIG. 12. In this position, the axis of rotation 239 has been lowered with respect to arms 112 and 114 by rotation of eccentric 132 and shaft 232 by 180°. Pressure roller 110 engages fusing roller 52 which pushes arms 112 and 114 up, compressing springs 122 and 124 and providing the force creating the desired pressure between the rollers.

This structure provides constant pressure despite some uncertainty in position of fusing roller 52. Shaft 232 and eccentric 132 are a reliable, compact mechanism that does not involve the typical cams for unloading fusing rollers that can wear and need replacement. The frictional problems incurred by conventional cams are eliminated by the fact that eccentrics 132 ride on bearings 235 during loading and unloading rotation by motor 130.

Insertion of the cartridge (described above) is accomplished when upper section 101 is open, i.e., has been pivoted with pin 106 moved away from slot 108 to a raised position. This position also allows the clearing of jams in the fuser. Lowering of the upper section 101 until pin 106 engages slot 108, positions the pressure and fusing rollers 110 and 52 for operation. The gearing 118 includes elements that accommodate the movement of the pressure roller relative to motor 116.

The invention has been described in detail with particular reference to a preferred embodiment thereof, but it will be understood that variations and modifications can be effected within the spirit and scope of the invention as described hereinabove and as defined in the appended claims.

We claim:

1. A fuser for fixing a toner image to a receiving sheet, said fuser comprising:

a pressure roller, a cartridge including, a housing having an access opening, said housing including a fusing roller skive integrally molded into said housing and defining at least a portion of one edge of said access opening, and a fusing roller mounted for rotation in said housing about an axis of rotation and positioned for engagement by said pressure roller through said access opening.

2. A fusing roller cartridge for insertion in a fuser which fuser includes a pressure roller and means for receiving said cartridge, said cartridge comprising:

a housing having an access opening, a fusing roller mounted for rotation in said housing about an axis of rotation, said fusing roller being engageable by said pressure roller through said access opening, said housing including a fusing roller skive integrally molded into said housing and positioned to define at least a portion of an edge of said access opening and positioned in close proximity with said fusing roller to control movement of a receiving sheet as the sheet exits a nip between said fusing roller and a pressure roller.

3. A fuser for fixing toner to a receiving sheet, said fuser comprising:

a pressure roller, a cartridge including, a housing having an access opening, said housing including a fusing roller skive defining at least a portion of one edge of said access opening, a fusing roller mounted for rotation in said housing about an axis of rotation and positioned for engagement by said pressure roller through said access opening, and a metal heat shield located between said fusing roller and said housing.

4. A fuser according to claim 3 wherein said heat shield surrounds at least a major portion of said fusing roller.

5. A fusing roller cartridge for insertion in a fuser which fuser includes a pressure roller and means for receiving said cartridge, said cartridge comprising:

a housing having an access opening, a fusing roller mounted for rotation in said housing about an axis of rotation, said fusing roller being engageable by the pressure roller through said access opening, said housing including a fusing roller skive positioned to define at least a portion of an edge of said access opening and positioned in close proximity with said fusing roller to control movement of a receiving sheet as the sheet exits the nip between the fusing roller and the pressure roller, and a heat shield surrounding at least a major portion of said fusing roller and positioned between said fusing roller and said housing to prevent said housing from becoming too hot for handling.

6. A fusing roller cartridge according to claim 5 including means separating said heat shield from said housing by an air space.

7. A fusing roller cartridge for insertion in a fuser which fuser includes a pressure roller and means for receiving said cartridge, said cartridge comprising:

a housing having an access opening, a fusing roller mounted for rotation in said housing about an axis of rotation, said fusing roller being engageable by the pressure roller through said access opening, said housing including a fusing roller skive positioned to define at least a portion of an edge of said access opening and positioned in close proximity with said fusing roller to control movement of a receiving sheet as the sheet exits a nip between said fusing roller and the pressure roller, and a cover, spring urged to a position covering said access opening and movable to an uncovering position permitting engagement of said fusing roller by the pressure roller.

8. A fusing roller cartridge according to claim 7 including a metal heat shield located between said fusing roller and said housing.

9. A fusing roller cartridge according to claim 7 further including a latch for latching said cover in its uncovering position, resilient means for urging said cover to its covering position and wherein said cartridge housing includes a single molded piece which defines said access opening, said skive and said latch.

* * * * *